United States Patent [19]

Stemmle

[11] Patent Number: 4,687,191

[45] Date of Patent: Aug. 18, 1987

[54] SORTER AND RECIPROCATING STAPLER APPARATUS

[75] Inventor: Denis J. Stemmle, Webster, N.Y.

[73] Assignee: Xerox Corporation, Stamford, Conn.

[21] Appl. No.: 854,216

[22] Filed: Apr. 21, 1986

[30] Foreign Application Priority Data

Apr. 23, 1985 [EP] European Pat. Off. ..... 85302824.9

[51] Int. Cl.[4] ..... B42B 1/02

[52] U.S. Cl. ..... 270/53; 271/293

[58] Field of Search ..... 270/53, 58, 37; 355/3 SH, 14 SH; 271/293, 294, 287, 296

[56] References Cited

U.S. PATENT DOCUMENTS

| | | | |
|---|---|---|---|
| 3,995,748 | 12/1976 | Looney | 270/53 |
| 4,361,393 | 11/1982 | Noto | 355/3 SH |
| 4,368,972 | 1/1983 | Naramore | 355/14 SH |
| 4,385,827 | 5/1983 | Naramore | 355/14 SH |
| 4,466,608 | 8/1984 | DuBois et al. | 271/293 |
| 4,466,609 | 8/1984 | Lawrence | 271/293 |
| 4,478,406 | 10/1984 | DuBois | 271/293 |
| 4,508,329 | 4/1985 | Hubler et al. | 270/53 |
| 4,566,782 | 1/1986 | Britt et al. | 270/53 |

OTHER PUBLICATIONS

IBM Technical Disclosure Bulletin, vol. 18, No. 3, Aug. 1975, pp. 617–618.

*Primary Examiner*—E. H. Eickholt

*Attorney, Agent, or Firm*—William A. Henry, II

[57] ABSTRACT

A sheet sorter of the nesting-bin type includes translatable bins that are driven so that there is an additional space between the bin immediately on top of a sheet-entry location and any superposed bins. This provides access to a corner of a set of sheets registered in that bin for a stapler which is reciprocable between a remote position permitting free indexing of the bins and an inner position in which it can be operated to staple the respective set of sheets together.

10 Claims, 3 Drawing Figures

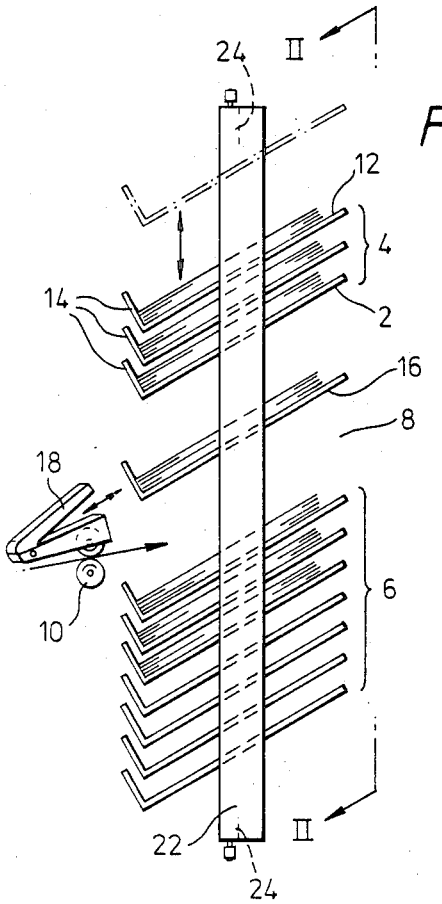
Fig.1.
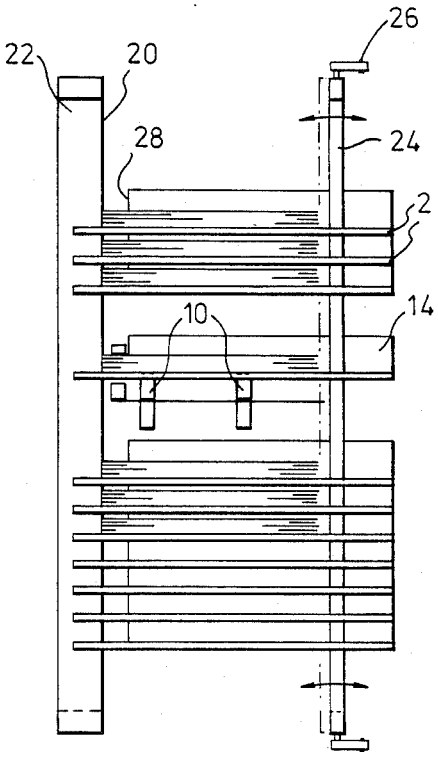
Fig.2.
Fig.3.
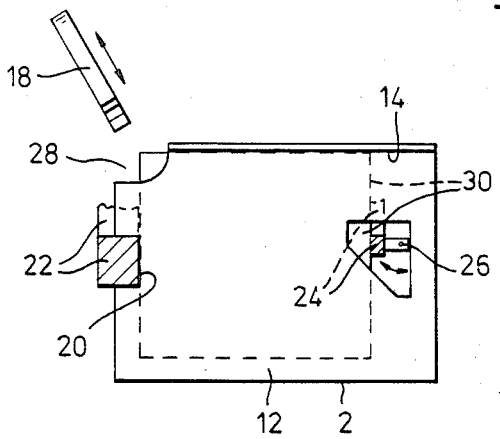

SORTER AND RECIPROCATING STAPLER APPARATUS

This invention relates to sheet sorters, particularly of the nested-bin type. Sheet sorters are devices by which a series of M identical copy sheets are put into M individual bins, the sorting operation being repeated N times so that each bin contains 1-to-N sheets.

In nested-bin sorters, the bins are movable relative to adjacent bins between a nested position, in which there is a chosen minimum spacing between the bins, and a spaced position, in which the lower bin is able to have a sheet fed into it. The bins are usually vertically translatable at differential speeds so that there generally are an upper and a lower group of bins spaced apart from each other to define a sheet entry location to which fresh sheet are fed at a rate related to the speed of vertical translation of the bins.

It is often desirable to 'finish' a sorting operation by stapling each set of copy sheets together.

The present invention aims at providing a sorter having an optionally-actuated stapler which is able to staple together all the registered sheets in an individual bin without moving the sheets, and accordingly provides a sheet sorter which is as claimed in the appended claims.

The present invention will now be described by way of example with reference to the accompanying drawings, in which:

FIG. 1 is a diagrammatic side view of a nested-bin sorter of the present invention;

FIG. 2 is a view along the line II—II of the sorter shown in FIG. 1, and FIG. 3 is a bird's eye view of an inclined sorter bin.

The sorter shown in the drawing has a plurality of bins 2 which generally are divided into an upper group 4 and a lower group 6. The bins are individually vertically translatable by means which are not shown. These means may include a helical cam or other device positioned at a height defining the location of a sheet entry port 8 aligned with pairs of sheet feed rollers 10. In one form of sheet sorter of the present invention the lower group 6 of bins is biased upwardly by means of a compression spring so that the top bin of the group 6 is able to be engaged by the helical cam or other lifting device so that when that is operated, it lifts the upper bin from the group in order to define the sheet entry port 8. Usually the thus-lifted bin is pushed by the lifting device against the underside of the upper group 4 of bins, and displaces them upwardly by the minimum bin spacing, against a downwards bias imparted by either gravity alone or in combination with that imparted by a lower-rated compression spring.

When in their nested positions, the minimum spacing-apart of the nested bins is dictated by means of spacers (not shown) which extend between adjacent bins, or members movable therewith, so that force on the upper or lower extreme bins in the appropriate direction causes its respective group of bins to move as a whole.

As can be seen in FIG. 1, each bin 2 is substantially L-shaped in vertical cross-section, having an upwardly-inclined support surface 12 and a perpendicular rear wall 14.

In accordance with the present invention, the lifting device is arranged to cause each bin to dwell at a stapling location indicated by the bin referenced 16, in which position the respective bin is spaced vertically from both groups of bins, being positioned above the sheet entry location and yet still spaced significantly below the upper group 4 of bins.

Aligned with bin 16 is a reciprocable stapler 18 positioned so that when it is reciprocated from its usual rest position, the anvil and head of the stapler are able to bracket a completed set of copy sheets resting in bin 16. The stapler can be reciprocated by any conventional means, such as, a gear and rotatable shaft driven by a motor or moved by a cam attached to a motor and returned to its rest position by means of a spring. When the stapler 18 has reached its inner limit operating position, it is able to be actuated (by conventional means which are not shown) so as to drive a staple through the aligned set of sheets, and to clinch the projecting ends of the staple to produce a stapled set of sheets.

Stapler 18 is positioned in such a location that it interferes neither with the vertical translation of the bins when the stapler is in its retracted position, nor with the free passage of sheets being fed into the sheet entry bin 8 by the rollers 10.

With the location of the feed rollers 10, and the orientation of the bins 2, it will be appreciated that each sheet enters the sheet entry bin while travelling upwardly, the speed of entry being such that the trail edge of the sheet clears the top of the rear wall 14 of the uppermost bin in the lower group 6. After the sheet has left the feed rollers 10, gravity causes it to decelerate and then fall into the respective bin, sliding over any sheets already in that bin until its trail edge comes to rest against wall 14, providing trail-edge registration.

As shown more clearly in FIG. 2, the bins extend horizontally between a fixed side registration edge 20 provided by an upright 22, and a reciprocating, vertical, patter bar 24 which is designed to come into contact with that side edge of each copy sheet which is remote from registration edge 20. As shown in FIG. 2, the patter bar 24 is rotatable about an axis 26. The horizontal spacing between registration edge 20 and axis 26 can be adjusted to ensure that the minimum distance between patter bar 24 and edge 20 corresponds to the respective dimension of the sheets being sorted at any one time.

As will be appreciated from the above description, the bins 2 are designed so that they can be indexed vertically relative to both upright 22 and patter bar 24, the bins having suitably-located and dimensioned cuts-out (shown in FIG. 3) to permit this relative movement in an unobstructed manner, while providing the necessary support to the copy sheets in all the bins. The bins also have cuts-out 28 in their rear walls, and in the adjacent surfaces 12, so that only the sheets are located between the jaws of the stapler 18 when it is in its inner operating position, so that the usually-metal portions of the bin are separated from, and therefore do not interfere with operation of, the stapler when the 'staple' mode has been selected. In FIG. 3, the position of a registered sheet is shown by the broken-line rectangle 30.

Usually the sorter will start with all the bins in the lowermost position, i.e. there is only a group 6, with there being no bin at position 16 and none in group 4. In this position, the top bin of the sorter receives the first sheet to be fed in by rollers 10. After this has happened, the lifting device is actuated to lift the top bin to position 16, in which it is held stationary for a chosen period. When this has been done, it enables the second bin to receive a sheet, with the usual sheet entry bin 8 having been formed between the first and second bins.

Before the third sheet can be fed, the bin in sheet 16 is lifted from the stapling position to form the first bin in group 4; the second bin is lifted to form stapling bin 16, and the third bin is now able to receive the third sheet. This process continues until M bins have each got one copy sheet in them. When this happens, the lowermost bin with the copy is caused to dwell at the sheet entry location for a position long enough to receive the first sheet of the next series of copy. Thereafter, the bins are indexed downwardly seriatim, so that each of the bins in the upper group first leaves that group to form the stapling bin 16, and then moves downwardly to become the top bin in group 6, at which it receives the next copy required for its set of copies. This whole process is iterated as many times as are necessary to put N copies in M bins. Once all copy sheets have been fed into the sorter bins, the bins are either all down in group 6 (if an even number of copies has been made of each set), or all but one of the bins are up in group 4 and in 16 (if there is an odd number of copies). If there is an even number of copies, and the 'staple' mode has been selected, the bins index upwardly, each pausing at position 16, permitting the stapler to move in; staple each set, and retract before the next bin index cycle. If there is an odd number of copy sheets per set, and the 'staple' mode has been selected, the bins index upwardly one additional cycle to move the lowermost filled bin to position 16. The stapler then advances; staples the aligned set, and retracts. Thereafter the bins are indexed downwardly seriatim, with each pausing at position 16 to permit its set to be stapled as discussed above.

Usually the copy sheets input to the sorter are the output of a xerographic copier or other type of printer. This copier is arranged to deliver its copies face side down, in the case of simplex copies, or with the first face down, in the case of duplex copies. This ensures that in each of the bins there is formed a set of copies on 1-to-N order from the bottom up. With the stapler being oriented as shown in the drawings, i.e. with the anvil uppermost, and the head down, this ensures that the clinched ends of the staples lie below sheet N of the stapled set, so that when the set has been removed from the bins and placed side 1 up, it presents the usual appearance.

It will thus be seen that the present invention provides a nested-bin sorter having an optionally-actuated stapler able to be moved quickly and easily into and out of its stapling position.

What is claimed is:

1. A nested-bin sheet sorter providing for trail-edge registration and for side-edge registration which is adjustable over a range of sheet sizes, and including means for increasing the normally-narrow spacing between adjacent bins sequentially during translation of the bins to provide an increased-space position, and for holding each bin stationary in said increased-space position for a chosen period, said sorter including a stapler which is reciprocable between a rest position in which it is clear of the bins, and an operating position in which it is able, when actuated, to staple together all the sheets in the said spaced bins, respectively, in said increased-space position.

2. A sorter as claimed in claim 1, in which the bins are L-shaped in cross-section, with a major support surface of each bin extending diagonally upwardly from a lower rear wall, over the top of which the copy sheets are fed into the sorter when a respective bin is aligned with a copy sheet inlet.

3. A sorter as claimed in claim 2, wherein said increased-space position for stapling is above an increased-space sheet entry position.

4. A sorter as claimed in claim 2, in which said stapler is reciprocable along an axis substantially parallel to said major support surface of each bin.

5. A sorter as claimed in claim 4, in which a vertical member presents a die registration face to all of said bins perpendicular to that afforded by said rear wall of each bin.

6. A sorter as claimed in claim 5, in which all the bins are threaded by a vertical patter bar movable transversely of its length by an adjustable extent so as to define a minimum spacing from the side registration face which corresponds to the respective dimension of the copy sheets being fed to the sorter.

7. A sorter as claimed in claim 6, in which said patter bar is rotatable about a vertical axis, and in which either the axis or the effect distance of the patter bar from the axis is adjustable relatively to the side registration face.

8. A sorter as claimed in claim 1, including a cut-out in the corner of each bin which permits a corner of the set of registered sheets supported thereby to be unsupported so as to permit the upper and lower sheets of the set to be engaged by hammer and anvil means of said stapler.

9. A sorter as claimed in claim 1, including at least two increased-space positions within said sorter after a first set of copy sheets have been stapled.

10. A sorter as claimed in claim 2, wherein there is an additional space between the bin immediately on top of the sheet entry position and any superposed bins.

* * * * *